US008998376B2

(12) United States Patent
Hayashi et al.

(10) Patent No.: US 8,998,376 B2
(45) Date of Patent: Apr. 7, 2015

(54) METHOD OF MANUFACTURING LIQUID EJECTION APPARATUS AND LIQUID EJECTION APPARATUS

(71) Applicants: Hideki Hayashi, Nagoya (JP); Keita Sugiura, Toyoake (JP); Yuki Takagi, Nagoya (JP); Jiro Yamamoto, Nagoya (JP)

(72) Inventors: Hideki Hayashi, Nagoya (JP); Keita Sugiura, Toyoake (JP); Yuki Takagi, Nagoya (JP); Jiro Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/220,287

(22) Filed: Mar. 20, 2014

(65) Prior Publication Data

US 2014/0292906 A1 Oct. 2, 2014

(30) Foreign Application Priority Data

Mar. 28, 2013 (JP) ..... 2013-069737

(51) Int. Cl.
*B41J 2/165* (2006.01)

(52) U.S. Cl.
CPC ..... *B41J 2/16532* (2013.01); *B41J 2/16523* (2013.01); *B41J 2/16585* (2013.01); *B41J 2002/16594* (2013.01)

(58) Field of Classification Search
USPC ..... 347/23
See application file for complete search history.

(56) References Cited

U.S. PATENT DOCUMENTS

| | | | | |
|---|---|---|---|---|
| 2004/0223027 | A1* | 11/2004 | Shinkawa et al. | 347/23 |
| 2004/0246294 | A1* | 12/2004 | Mitsuzawa | 347/23 |
| 2010/0103217 | A1* | 4/2010 | Takase | 347/30 |

FOREIGN PATENT DOCUMENTS

| | | |
|---|---|---|
| JP | H11-078065 | 3/1999 |
| JP | 2007-301907 | 11/2007 |
| JP | 2010-125746 | 6/2010 |
| JP | 2010-131982 | 6/2010 |

* cited by examiner

*Primary Examiner* — Stephen Meier
*Assistant Examiner* — Alexander D Shenderov
(74) *Attorney, Agent, or Firm* — Frommer Lawrence & Haug LLP

(57) ABSTRACT

A liquid ejection apparatus includes: a head having ejection-opening groups and ejection-passage groups; caps for covering the respective ejection-openings groups; and suction passages connecting between the interiors of the respective caps and a sucking device. A method of manufacturing the liquid ejection apparatus includes: a step of classifying, as a first group, an ejection-opening group corresponding to an ejection-passage group having a resistance value not less than a first value and classifying, as a second group, another ejection-opening group corresponding to an ejection-passage group having a resistance value less than the first value; and a step of assigning at least one suction passage having a resistance value less than a second value to the ejection-opening group as the first group and assigning another at least one suction passage having a resistance value not less than the second value to the ejection-opening group as the second group.

10 Claims, 9 Drawing Sheets

METHOD OF MANUFACTURING LIQUID EJECTION APPARATUS AND LIQUID EJECTION APPARATUS

CROSS REFERENCE TO RELATED APPLICATION

The present application claims priority from Japanese Patent Application No. 2013-069737, which was filed on Mar. 28, 2013, the disclosure of which is herein incorporated by reference in its entirety.

BACKGROUND

1. Technical Field

The present invention relates to a method of manufacturing a liquid ejection apparatus for ejecting liquid such as ink, and the liquid ejection apparatus.

2. Description of the Related Art

There is conventionally known a liquid ejection apparatus in which a plurality of ejection-opening groups formed in a liquid ejection head are respectively covered with caps, and a sucking device generates a suction force in each cap to discharge high-viscosity liquid from ejection passages formed in the liquid ejection head.

SUMMARY

However, an amount of liquid discharged in the above-described. discharge operation (hereinafter may be referred to as "liquid discharge amount") may vary among the plurality of ejection-opening groups due to differences in resistance values of the ejection passages. This variation may result in unnecessary consumption of liquid due to too much liquid discharged or result in remaining of the high-viscosity liquid in the ejection passages due to too little liquid discharged.

To solve this problem, it is possible to consider uniformalizing the resistance values of the ejection passages among the plurality of ejection-opening groups. However, this uniformalization is difficult due to manufacturing errors and may cause deterioration of yields, leading to higher manufacturing cost.

This invention has been developed to provide a method of manufacturing a liquid ejection apparatus and the liquid ejection apparatus which can reduce an amount of deterioration of yields and a difference in liquid discharge amount among a plurality of ejection-opening groups.

The present invention provides a method of manufacturing a liquid ejection apparatus. The liquid ejection apparatus comprises: at least one liquid ejection head comprising: a plurality of ejection-opening groups each constituted by a plurality of ejection openings for ejecting liquid; and a plurality of ejection-passage groups respectively corresponding to the plurality of ejection-opening groups and each constituted by a plurality of ejection passages respectively extending to the plurality of ejection openings of a corresponding one of the plurality of ejection-opening groups; a plurality of caps provided respectively for the plurality of ejection-opening groups and formed respectively with a plurality of recesses each for covering the plurality of ejection openings of a corresponding one of the plurality of ejection-opening groups; a moving device configured to move the plurality of caps relative to the at least one liquid ejection head to a capping position at which each of the plurality of recesses covers a corresponding one of the plurality of ejection-opening groups and an uncapping position at which each of the plurality of caps is spaced apart from a corresponding one of the plurality of ejection-opening groups; a plurality of suction passages respectively communicating with the plurality of recesses respectively formed in the plurality of caps; at least one sucking device configured to suck fluid through the plurality of suction passages from the plurality of recesses respectively formed in the plurality of caps; a controller configured to control the moving device to move each of the plurality of caps selectively to one of the capping position and the uncapping position and control the at least one sucking device such that when each of at least one of the plurality of caps is located at the capping position, a corresponding at least one of the at least one sucking device sucks the fluid from at least one of the plurality of recesses which corresponds to the at least one of the plurality of caps. The method comprises: a classification step of classifying at least one ejection-opening group of the plurality of ejection-opening groups as a first group and classifying another at least one ejection-opening group of the plurality of ejection-opening groups as a second group, the at least one ejection-opening group each corresponding to a corresponding one of the plurality of ejection-passage groups which has a resistance value equal to or greater than a first value, said another at least one ejection-opening group each corresponding to a corresponding one of the plurality of ejection-passage groups which has a resistance value less than the first value; and an assignment step of assigning at least one suction passage of the plurality of suction passages to each of the at least one ejection-opening group classified as the first group in the classification step and assigning another at least one suction passage of the plurality of suction passages to each of the at least one ejection-opening group classified as the second group in the classification step, a resistance value of the at least one suction passage being less than a second value, a resistance value of said another at least one suction passage being equal to or greater than the second value.

The present invention provides the liquid ejection apparatus manufactured in the method. The liquid ejection apparatus further comprises: a plurality of pressure sensors provided respectively for the plurality of suction passages and each configured to output a signal indicative of a pressure in a corresponding one of the plurality of suction passages; and a plurality of adjusters provided respectively for the plurality of suction passages and each configured to adjust a resistance value of a corresponding one of the plurality of suction passages. The controller is configured to control the plurality of adjusters based on the signals output respectively from the plurality of pressure sensors.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

Figure 1:
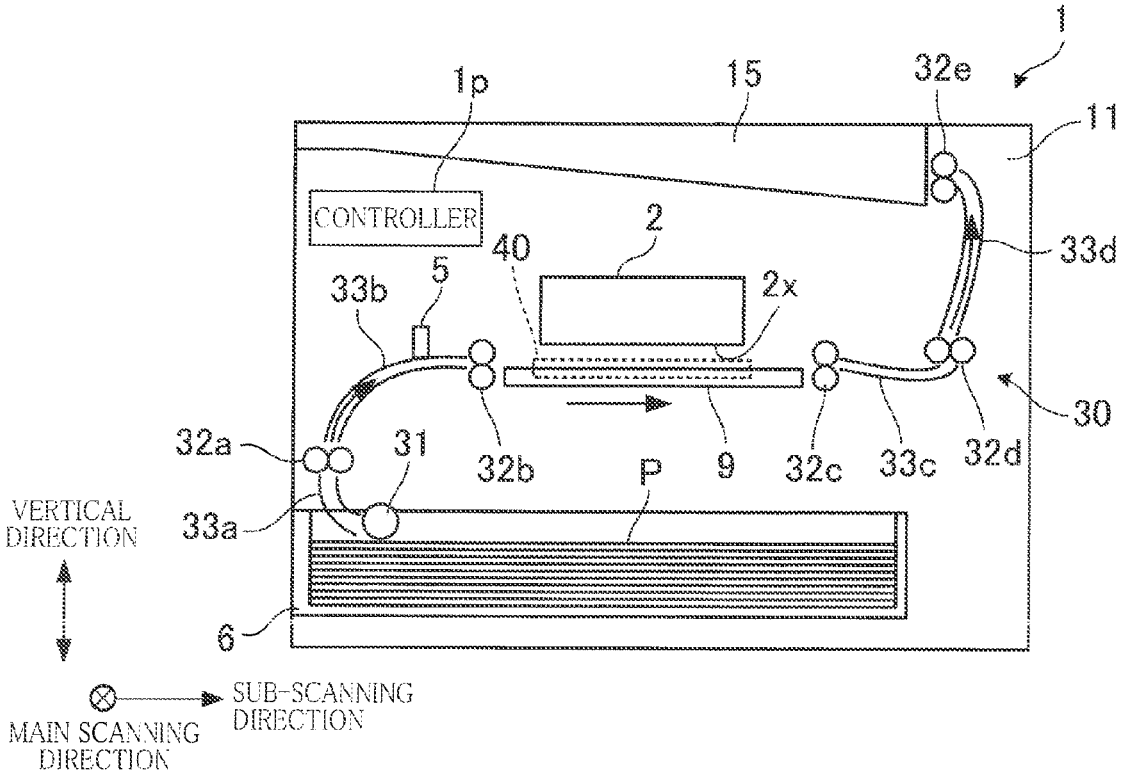
FIG. 1 is a schematic side view illustrating an internal structure of an ink-jet printer according to a first embodiment of the present invention.

Hereinafter, there will be described embodiments of the present invention by reference to the drawings.

First, there will be explained, with reference to FIG. 1, an overall construction of an ink-jet printer 1 according to a first embodiment of the present invention.

The printer 1 includes a housing 11 having a rectangular parallelepiped shape. A sheet-output portion 15 is provided on an upper surface of a top plate of the housing 11. The housing 11 accommodates various devices and components including an ink-jet head 2, a maintenance unit 40, a platen 9, a sheet sensor 5, a sheet-supply tray 6, a conveyor unit 30, and a controller 1*p*. Formed in the housing 11 is a conveyance path through which a sheet P is conveyed from the sheet-supply tray 6 to the sheet-output portion 15 along arrows illustrated in FIG. 1. The head 2 is fixed and records an image in this state, that is, the printer 1 is a line printer. The housing 11 also accommodates four cartridges, not shown, arranged corresponding to the head 2. The four cartridges respectively store inks of respective different colors, namely yellow, cyan, magenta, and black and are connected to the head 2 via tubes.

A lower surface of the head 2 is an ejection surface 2*x* having a plurality of ejection openings 8 (see FIG. 2A) formed therein. The plurality of ejection openings 8 are divided into six ejection-opening groups 8*x* in each of which the ejection openings 8 are formed in a rectangular area. The ejection-opening groups 8*x* are arranged in two rows in a staggered configuration in a main scanning direction. Each of the ejection-opening groups 8*x* is constituted by the ejection openings 8 arranged in six rows (each may be referred to as "ejection opening row") extending in the main scanning direction. These six ejection opening rows are arranged in a sub-scanning direction which is perpendicular to the main scanning direction. In each of the ejection-opening groups 8*x*, upstream three ejection opening rows are assigned to the color inks, and downstream three ejection opening rows to the black ink in a direction in which the sheet P is conveyed by the conveyor unit 30 (hereinafter referred to as "conveying direction"). Specifically, the upstream three ejection opening rows are assigned respectively to the yellow ink, the cyan ink, and the magenta ink in order from the upstream side in the conveying direction.

The maintenance unit 40 includes six caps 41 (see FIG. 2B) respectively provided for the six ejection-opening groups 8*x*, When driven, the maintenance unit 40 performs an ink discharge operation in which the ink is ejected from the ejection openings 8 to remove or prevent clogging of the ejection openings 8 and other problems.

The structures of the head 2 and the maintenance unit 40 will be explained later in more detail.

The platen 9 has a planar plate shape and opposes the head 2 in a vertical direction that is perpendicular to each of the main scanning direction and the sub-scanning direction. A predetermined space appropriate for recording or forming an image is formed between an upper surface of the platen 9 and the ejection surface 2*x* of the head 2.

The sheet sensor 5 is disposed upstream of the head 2 in the conveying direction. The sheet sensor 5 senses a leading edge of the sheet P to output a sense signal to the controller 1*p*.

The sheet-supply tray 6 is a box opening upward and removably mounted on the housing 11. The sheet-supply tray 6 can accommodate a plurality of sheets P.

The conveyor unit 30 includes a pick-up roller 31, nip roller pairs 32*a*, 32*b*, 32*c*, 32*d*, 32*e*, and guides 33*a*, 33*b*, 33*c*, 33*d*. The controller IP controls a sheet-supply motor 6M (see FIG. 5) to rotate the pick-up roller 31 to supply an uppermost one of the sheets stored in the sheet-supply tray 6. The nip roller pairs 32*a*-32*e* are arranged along the conveyance path in this order from the upstream side in the conveying direction. One roller of each of the nip roller pairs 32*a*-32*e* is a drive roller which is rotated by a conveyor motor 7M (see FIG. 5) driven under the control of the controller 1*p*. The other roller is a driven roller which is rotated by the rotation of the drive roller. The guides 33*a*-33*d* are arranged along the conveyance path in this order from the upstream side in the conveying direction such that the nip roller pairs 32*a*-32*e* and the guides 33*a*-33*d* are arranged alternately. Each of the guides 33*a*-33*d* is constituted by a pair of plates opposed to each other.

Figure 5:
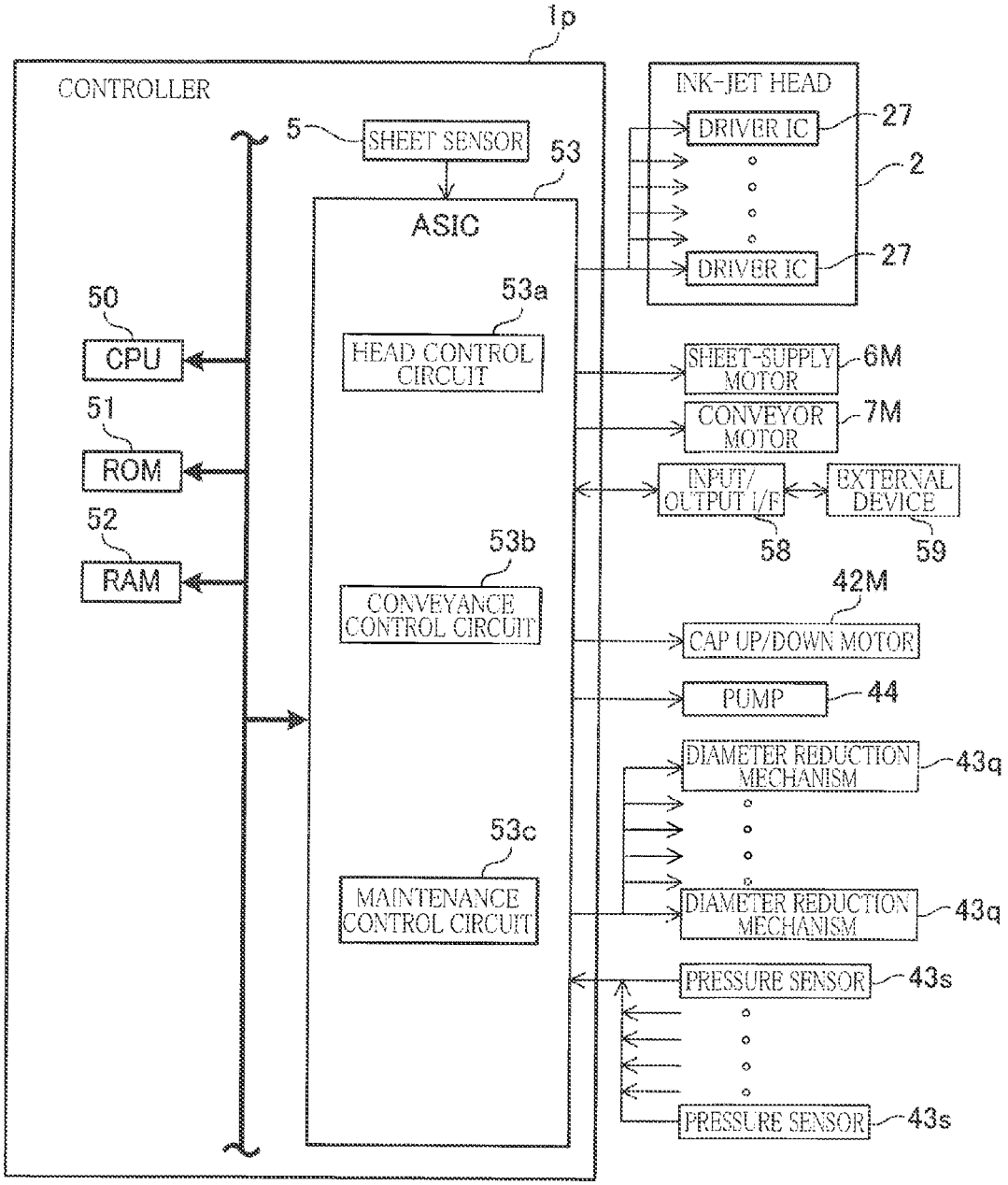
FIG. 5 is a block diagram illustrating an electric configuration of the printer.

After supplied from the sheet-supply tray 6 by the pick-up roller 31 under the control of the controller 1*p*, the sheet P is nipped and conveyed by the nip roller pairs 32*a*-32*e* in the conveying direction while guided by the guides 33*a*-33*d*. When the sheet P passes through a position just below the head 2 while supported on the upper surface of the platen 9, the controller 1*p* controls the head 2 to eject the various colors of ink from the ejection openings 8 (see FIG. 2A) to a surface of the sheet P. This ink ejecting operation is performed based on the sense signal output from the sheet sensor 5. The sheet P on which the image is formed is discharged onto the sheet-output portion 15 through an opening formed in an upper portion of the housing As illustrated in FIG. 5, the controller 1*p* includes a central processing unit (CPU) 50, a read only memory (ROM) 51, a random access memory (RAM) 52, an application specific integrated circuit (ASIC) 53, and a bus 54. The ROM 51 stores programs to be executed by the CPU 50, various kinds of fixed data, and other similar data sets. The RAM 52 temporarily stores data such as image data which is necessary for the CPU 50 to execute the programs. The ASIC 53 includes a head control circuit 53*a*, a conveyance control circuit 53*b*, and a maintenance control circuit 53*c*. This ASIC 53 is connected to an external device 59 such as a personal computer (PC) by an input/output interface 58 such that data can be transferred between the ASIC 53 and the external device 59. The head control circuit 53*a* controls a driver IC 27 based on recording data transmitted from the external device 59. The conveyance control circuit 53*b* controls the sheet-supply motor 6M and the conveyor motor 7M based on the recording data transmitted from the external device 59. As will be explained later in detail, the maintenance control circuit 53*c* controls a platen elevating and lowering mechanism, not shown, a maintenance-unit moving mechanism, not shown, a cap up/down motor 42M, and a pump 44 based on a maintenance command and controls a diameter reduction mechanism 43*q* based on a suction condition stored in the ROM 51.

It is noted that the single CPU 50 executes processings relating to various controls in the present embodiment, but this invention is not limited to this configuration. For example, the processings may be executed by a plurality of CPUs, an ASIC, or a combination of one or more CPUs and one or more ASICs.

Figure 2A:
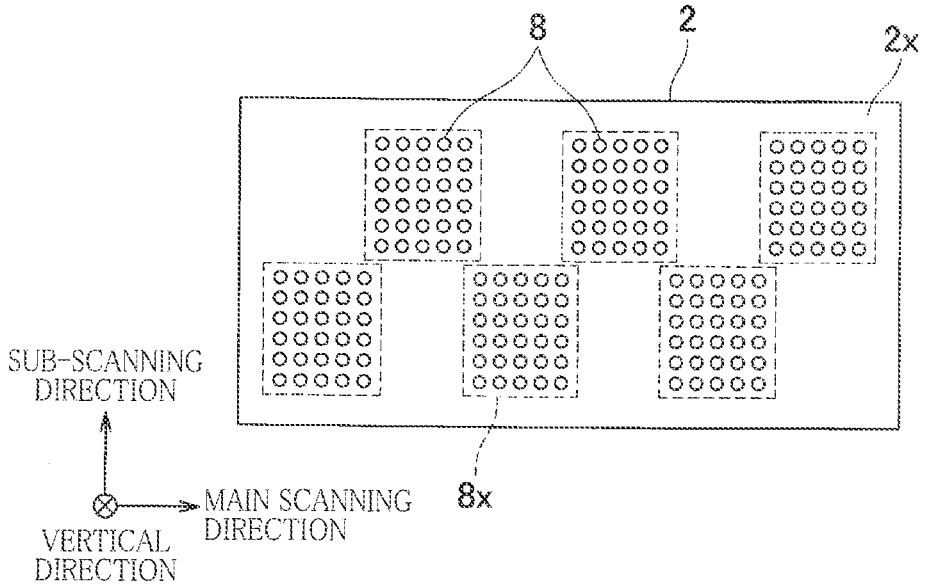
FIG. 2A is a plan view illustrating an ink-jet head of the printer illustrated in FIG. 1.
Figure 3:
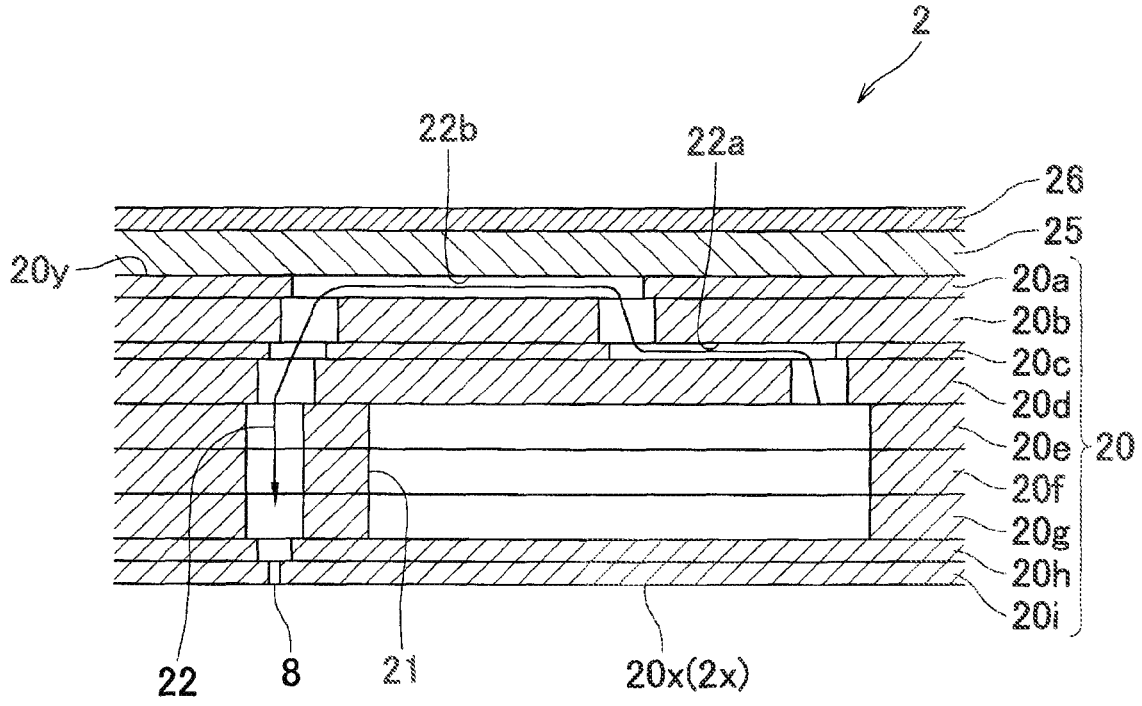
FIG. 3 is a partial cross-sectional view of the head.

There will be next explained the head 2 in detail with reference to FIG. 2A and FIG. 3.

The head 2 includes: one passage member 20 having ejection passages respectively extending to the ejection openings 8; six actuator units 25 provided on the passage member 20 for the respective ejection-opening groups 8*x;* and six COFs (chip on films) 26 (see FIGS. 2A and 3) provided on the respective actuator units 25.

As illustrated in FIG. 3, the passage member 20 is a stacked body constituted by nine metal plates 20*a*, 20*b*, 20*c*, 20*d*, 20*e*, 20*f*, 20*g*, 20*h*, 20*i* having generally the same size and bonded to each other. The ejection passages are formed for each of the ejection-opening groups 8*x* and each includes: a common passage 21 defined for all the ejection openings 8 of the ejection-opening group 8*x;* and individual passages 22 defined for the respective ejection openings 8. The individual passages 22 extend respectively from an outlet of the common passage 21 to the ejection openings 8 via apertures 22*a* and pressure chambers 22*b*. The pressure chambers 22*b* are open in an upper surface 20*y* of the passage member 20, and the ejection openings 8 in a lower surface 20*x* of the passage member 20. The lower surface 20*x* functions as the above-described ejection surface 2*x*. The pressure chambers 22*b* are divided into six pressure chamber groups corresponding to the ejection-opening groups 8*x*. Like the six ejection-opening groups 8*x*, the pressure chambers 22*b* of each of the six pressure chamber groups are formed in a rectangular area and arranged in two rows in a staggered configuration in the main scanning direction.

Each of the six actuator units 25 is fixed to the upper surface 20*y* at an area covering the pressure chambers 22*b* of a corresponding one of the pressure chamber groups. Each of the actuator units 25 includes a plurality of piezoelectric actuators provided for the respective pressure chambers 22*b*.

The six COFs 26 are fixed to upper surfaces of the respective actuator units 25. Each of the COFs 26 is a flat wiring board provided with a plurality of wirings, and the driver IC 27 (see FIG. 5) is mounted on each COF. Each wiring of the COF 26 connects between an output terminal of the driver IC 27 and an electrode of the corresponding piezoelectric actuator.

When the controller 1*p* controls the driver IC 27 to apply a predetermined electric potential to the piezoelectric actuators, the piezoelectric actuators are selectively driven. As a result, energy is applied to the ink in the pressure chambers 22*b* to eject the ink from the ejection openings 8, so that the ink is ejected from the ejection openings 8.

Figure 2B:
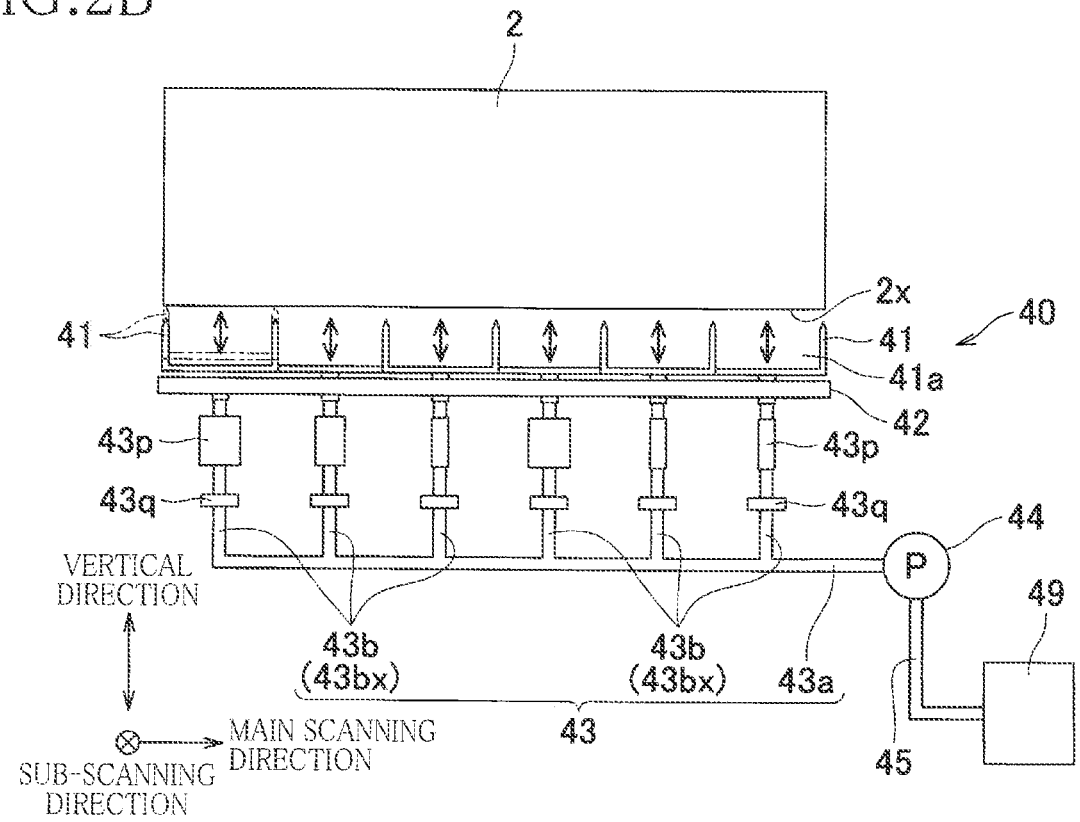
FIG. 2B is a site view illustrating the head and a maintenance unit.
Figure 4:
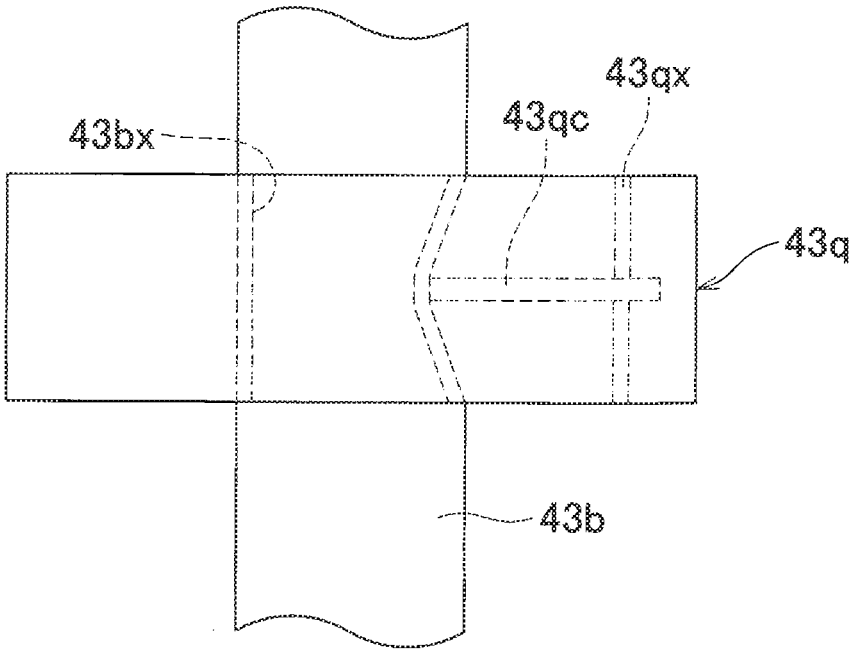
FIG. 4 is an enlarged view illustrating a diameter reduction mechanism and a portion of a branched tube.

There will be next explained the maintenance unit 40 in detail with reference to FIGS. 2B and 4.

As illustrated in FIG. 2B, the maintenance unit 40 includes the six caps 41, a cap elevating and lowering mechanism 42, a suction tube 43, the pump 44, a waste liquid tube 45, and a waste liquid tank 49.

Each of the six caps 41 is formed of elastic material and includes a recessed portion 41 a for covering the plurality of ejection openings 8 of a corresponding one of the ejection-opening groups 8*x*. The recessed portion 41*a* is constituted by a bottom portion and a side portion. The side portion is a projection projecting from the bottom portion to enclose the interior of the cap 41. Each cap 41 can be elevated and lowered by the cap elevating and lowering mechanism 42. As a result, each cap 41 is moved relative to the head 2 and selectively located at one of (a) a capping position (indicated by broken lines at the leftmost cap 41 in FIG. 2B) at which the recessed portion 41*a* of the cap 41 covers the corresponding ejection openings 8 and (b) an uncapping position (indicated by solid lines at the leftmost cap 41 in FIG. 2B) at Which the recessed portion 41*a* of the cap 41 does not cover the corresponding ejection openings 8. When the cap 41 is located at the capping position, a distal end of its side portion is held in contact with the ejection surface 2*x* at its area enclosing the corresponding ejection-opening group 8*x* (i.e., a rectangular area indicated by broken lines in FIG. 2A). In this state, the plurality of ejection openings 8 covered with the cap 41 are isolated from or do not communicate with the outside space. When the cap 41 is located at the uncapping position, the distal end of the side portion is spaced apart from the ejection surface 2*x*. In this state, the plurality of ejection openings 8 are open to or communicate with the outside space.

The cap elevating and lowering mechanism 42 includes a supporter for supporting the six caps 41, a mechanism including, e.g., a cam for elevating and lowering the supporter, and an up/down motor 42M (see FIG. 5) for driving the mechanism. The controller 1*p* controls and rotates the up/down motor 42M to drive the mechanism, so that the six caps 41 are elevated or lowered with the supporter. The cap elevating and lowering mechanism 42 can elevate and lower all the six caps 41 at the same time.

The suction tube 43 connects between each cap 41 and the pump 44 and includes one main tube 43*a* and branched tubes 43*h* branched off from the main tube 43*a*.

Each of the branched tubes 43*b* is provided with an attachment 43*p*, the diameter reduction mechanism 43*q*, and a pressure sensor 43*s* (see FIG. 5). The pressure sensor 43*s* sends the controller 1*p* a signal indicative of a pressure in a suction passage 43*bx* formed in a corresponding one of the branched tubes 43*b*. The resistance value of the suction passage 43*bx* is adjusted by the attachment 43*p* and can be adjusted by the diameter reduction mechanism 43*q*.

The attachment 43*p* is a tubular member attached to a middle portion of the branched tube 43*b*. The present embodiment provides three types of attachments 43*p* having ink flow passages whose cross-sectional areas are large, medium, and small, respectively. FIG. 2B illustrates the attachments 43*p* having ink flow passages whose cross-sectional areas are large, medium, small, large, small, and small in order from the left side. A passage resistance value is smaller in the attachment 43*p* having a large ink flow passage in cross section (i.e., cross-sectional area of ink flow passage passage) than in the attachment 43*p* having a small ink flow passage in cross section. The six branched tubes 43*b* have the same structure except for a portion to which the attachment 43*p* is attached. The resistance value of the suction passage 43*bx* depends upon the passage resistance value of the attachment 43*p*.

As will be described later, the ejection-opening groups 8*x* are classified into three ranks or groups by the resistance value of the ejection passage. The ejection-opening group 8*x* whose passage resistance value is large is associated with the attachment 43*p* having the ink flow passage whose cross-sectional area is large (i.e., the passage resistance value is small). The ejection-opening group 8*x* whose passage resistance value is medium is associated with the attachment 43*p* having the ink flow passage whose cross-sectional area is medium (i.e., the passage resistance value is medium). The ejection-opening group 8*x* whose passage resistance value is small is associated with the attachment 43*p* having the ink flow passage whose cross-sectional area is small (i.e., the passage resistance value is large). As a result, when each cap 41 is located at the capping position, resistance values are generally the same among six passages extending from the cartridges to the waste liquid tank 49 via the head 2.

Each diameter reduction mechanism 43*q* can change the cross-sectional area of the corresponding suction passage 43*bx*. Specifically, as illustrated in FIG. 4, the diameter reduction mechanism 43*q* includes a shaft 43*qx*, a cam 43*qc* mounted on the shaft 43*qx*, a motor, not shown, for rotating the shaft 43*qx*, and a sensor, not shown, for outputting a signal indicative of an amount of rotation of the shaft 43*qx*. The controller 1*p* controls the motor based on the signal transmitted from the sensor. The rotation of the shaft 43*qx* changes an amount of compression of the branched tube 43*b* by the cam 43*qc*, resulting in change of the cross-sectional area of the suction passage 43*bx*. As a result, the resistance value of the suction passage 43*bx* is adjusted.

The pump 44 generates a force of suction (a suction force) which is transferred to the six caps 41 through the respective suction passages 43*bx*. The waste liquid tube 45 connects between the pump 44 and the waste liquid tank 49.

During a standby state of the printer 1, the maintenance unit 40 is located at a waiting position at which the caps 41 are not opposed to the head 2 in the vertical direction (e.g., a back-side position in FIG. 1).

When the printer 1 performs the ink discharge operation, the maintenance control circuit 53*c* first controls the platen elevating and lowering mechanism to lower the platen 9 based on the maintenance command. The maintenance control circuit 53*c* then controls the maintenance-unit moving mechanism to move the maintenance unit 40 in the main scanning direction to a maintenance position at which the caps 41 are opposed to the head 2 in the vertical direction. The maintenance control circuit 53*c* then controls the diameter reduction mechanism 43*q* based on the suction condition stored in the ROM 51 to change the cross-sectional area of the suction passage(s) 43*bx*. The maintenance control circuit 53*c* then controls the cap up/down motor 42M to move each cap 41 upward to the capping position. When each cap 41 is located at the capping position, the maintenance control circuit 53*c* controls the pump 44 to generate the suction force in each of the six caps 41. As a result, the ink is discharged from all the ejection openings 8.

Figure 6:
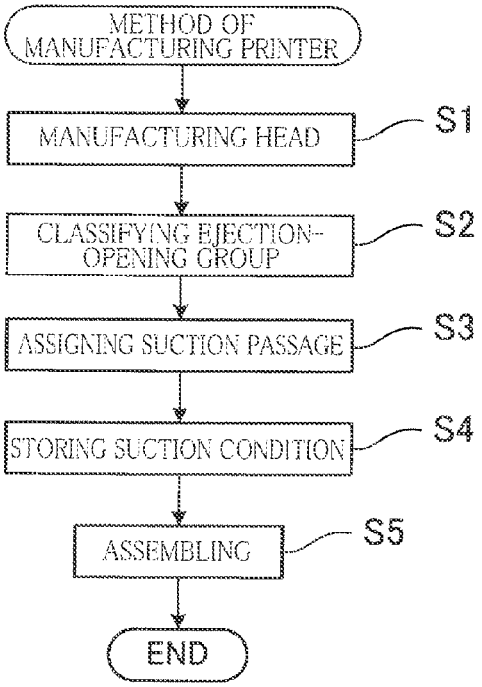
FIG. 6 is a flow chart illustrating a method of manufacturing the printer.

There will be next explained a method of manufacturing the printer 1 with reference to FIG. 6.

First, the head 2 is manufactured (S1). Specifically, the constituent components of the head 2 such as the passage member 20, the six actuator units 25, and the COFs 26 are manufactured or provided and then assembled to manufacture the head 2.

After the completion at S1, each of the six ejection-opening groups 8*x* is classified as any of a plurality of ranks including: a first rank in which the resistance value of the ejection passage is equal to or larger than a first predetermined value; and a second rank in which the resistance value of the ejection passage is smaller than the first predetermined value as the reference resistance value of the first rank (S2: rank classification step). In the present embodiment, each of the six ejection-opening groups 8*x* is classified as any of the first rank, the second rank, and a third rank in Which the resistance value of the ejection passage is smaller than the reference resistance value of the second rank. In this classification, a pressurizing pump communicating with ejection passages in the head 2 manufactured at S1 is first driven, with the ejection passages being filled with suitable liquid (e.g., preservative liquid). As a result, a constant pressure is applied to the liquid in the ejection passages to discharge the liquid from all the ejection openings 8. For each of the ejection-opening groups 8*x*, an amount of liquid discharged per unit time is then measured, and the resistance value of the ejection passages is calculated based on a result of the measurement. Each of the six ejection-opening groups 8*x* is then classified as one of the three ranks.

After the completion at S2, the attachment 43*p* having the ink flow passage whose cross-sectional area is large is assigned to the ejection-opening groups 8*x* classified as the first rank, the attachment 43*p* having the ink flow passage whose cross-sectional area is medium to the ejection-opening groups 8*x* classified as the second rank, and the attachment 43*p* having the ink flow passage whose cross-sectional area is small to the ejection-opening groups 8*x* classified as the third rank (S3; assignment step).

After the completion at S3, the suction condition for each combination of the ejection-opening group 8*x* and the attachment 43*p* assigned at S3 is stored into the ROM 51 (S4: suction condition storage step). The suction condition is a condition relating to the suction force generated in each cap 41 in the ink discharge operation and in the present embodiment includes a driving condition for each diameter reduction mechanism 43*q*, i.e., an amount of adjustment for the passage resistance value by each diameter reduction mechanism 43*q*. At S4, a controller of a printer manufacturing device determines the suction condition based on the signal transmitted from the pressure sensor 43*s* and stores the suction condition into the ROM 51. It is noted that, at S4, the suction pump connected to the passage communicating with the suction passages 43*bx* is driven, and the suction condition is determined based on the signal transmitted from the pressure sensor 43*s* for each suction passage 43*bx* when the ink is being sucked by the suction pump. For example, the diameter reduction mechanisms 43*q* are adjusted such that the passage resistance of the diameter reduction mechanism 43*q* provided for the suction passage 43*bx* in Which relatively low pressure is detected during suction is larger than the passage resistance of the diameter reduction mechanism 43*q* provided for the suction passage 43*bx* in which relatively high pressure is detected during suction.

After the completion at S4, constituent components of the printer 1 (which include the head 2 manufactured at S1, the maintenance unit 40 corresponding to the structure assigned at S3, and the housing 11) are assembled at S5. As a result, the printer 1 is completed.

In the printer 1 according to the present embodiment and the method of manufacturing the printer 1 as described above, the rank classification step S2 and the assignment step S3 uniformalize the passage resistances in combinations of the ejection-opening groups 8*x* and the suction passages 43*bx*, resulting in reduced difference in liquid discharge amount among the six ejection-opening groups 8*x*. That is, it is possible to reduce an amount of deterioration in yields and reduce the difference in liquid discharge amount among the six ejection-opening groups 8*x*.

The assignment step S3 is a step for assigning the suction passages 43*bx* provided with the attachments 43*p* whose cross-sectional areas differ from each other according to their ranks. This configuration enjoys easiness and lower cost in manufacturing the printer 1 in which the passage resistances in combinations of the ejection-opening groups 8*x* and the suction passages 43*bx* are made uniform.

The single pump 44 is provided for the six caps 41. In a case where one pump 44 is provided for each of the caps 41, a cost of manufacturing the printer 1 increases by increase in the number of the pumps 44. Also, this case requires, e.g., settings of the suction condition for each pump 44, leading to complicated control. In the present embodiment, however, it is possible to eliminate the increase in cost and the complicated control.

The plurality of ejection openings 8 constituting the six ejection-opening groups 8*x* are formed in one member, namely, the passage member 20. Accordingly, it is possible to reduce an amount of variation of ranks among the six ejection-opening groups 8*x* when compared with a case where the plurality of ejection openings 8 constituting the six ejection-opening groups 8*x* are formed in different components.

After the rank classification, step S2 and the assignment step S3, the suction condition is stored into the ROM 51 at S4, resulting in reliable reduction in the difference in the liquid discharge amount among the six ejection-opening groups 8*x*.

The suction condition is determined at S4 based on the signals output from the pressure sensors 43*s*. Accordingly, the suction condition can be determined more reliably. Also, the pressure sensor 43*s* may be provided in the printer in order to detect a malfunction of the pressure in the suction passage 43*bx*, for example. Thus, using the pressure sensor 43*s* to determine the suction condition is more effective because this configuration does not require any additional components.

The suction condition includes the amount of adjustment fur the passage resistance value by each diameter reduction mechanism 43*q*. Thus, there is no need to provide the pump 44 for each cap 41 and set driving conditions for the pumps 44, for example, resulting in more effective reduction in the difference in the liquid discharge amount among the six ejection-opening groups 8*x*.

Each diameter reduction mechanism 43*q* can change the cross-sectional area of the corresponding suction passage 43*bx* (see FIG. 4). Accordingly, the resistance value can be easily changed with respect to various ranks.

Figure 7:
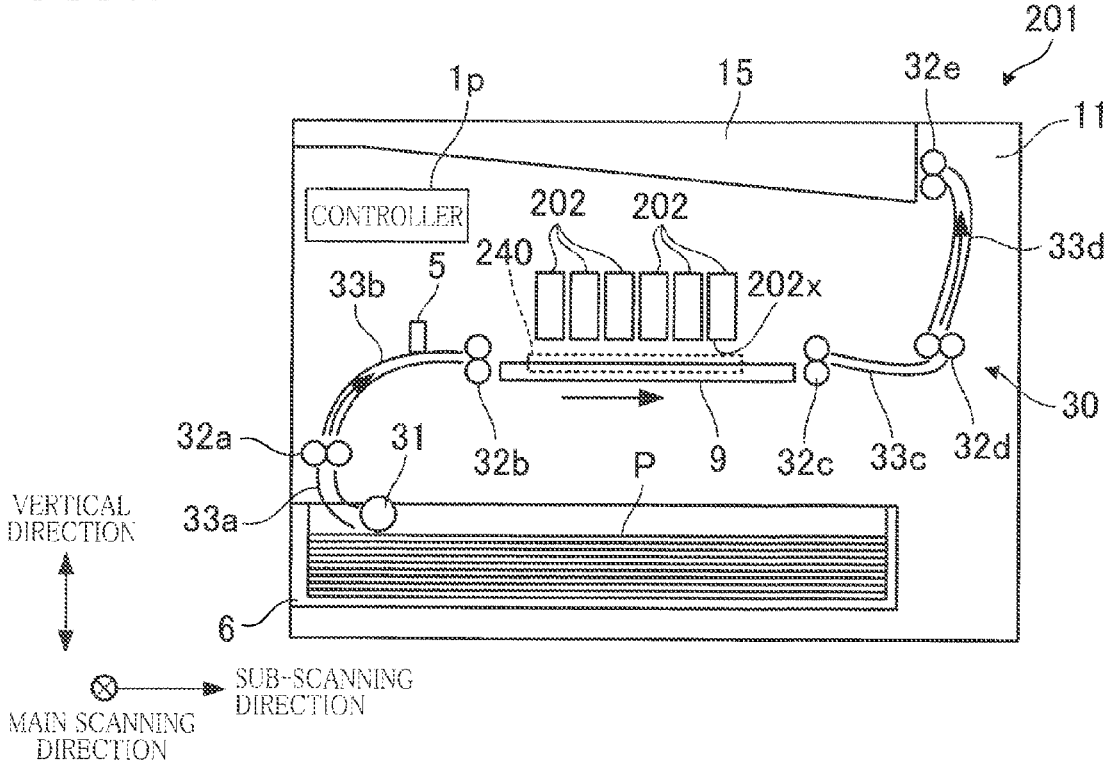
FIG. 7 is a schematic side view illustrating an internal structure of an ink-jet printer according to a second embodiment of the present invention.
Figure 8:
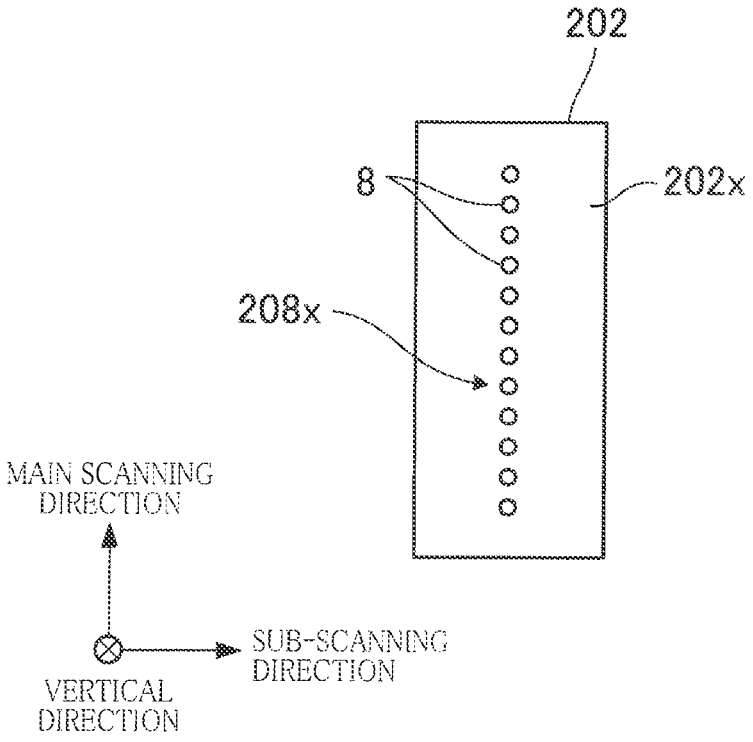
FIG. 8 is a plan view illustrating one of ink-jet heads of the printer illustrated in FIG. 7.
Figure 9:
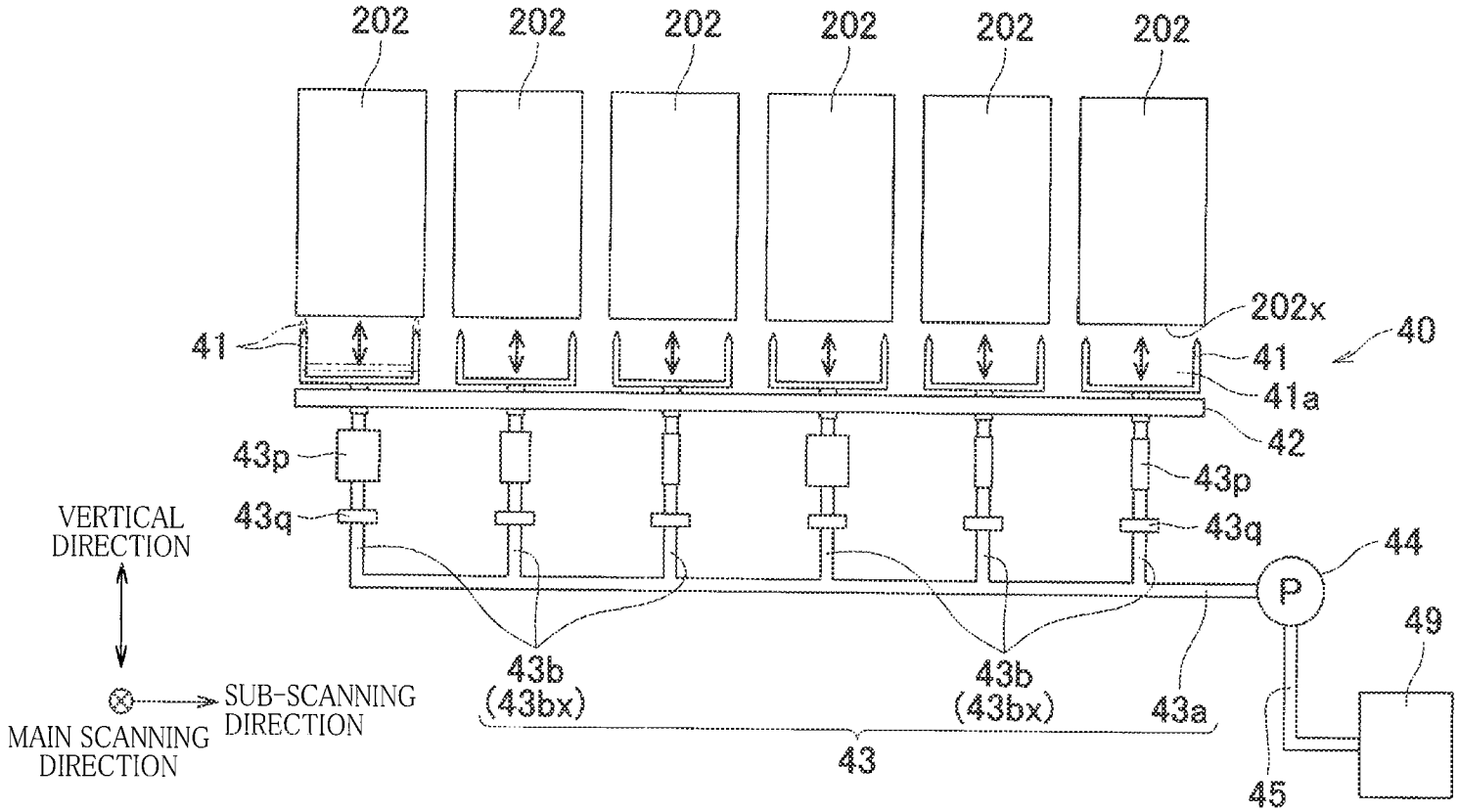
FIG. 9 is a side view illustrating the six heads and a maintenance unit of the printer illustrated in FIG. 7.

There will be next explained an ink-jet printer 201 according to a second embodiment of the present invention with reference to FIGS. 7-9.

The printer 201 is different from the printer 1 according to the first embodiment only in that the printer 201 includes six ink-jet heads 202 instead of the single ink-jet head 2.

The six heads 202 respectively eject yellow ink, light cyan ink, light magenta ink, cyan ink, magenta ink, and black ink in order from the upstream side in the conveying direction. Each of the heads 202 has a lower surface in the form of an ejection surface 202*x* having the plurality of ejection openings 8 (see FIG. 8). The ejection openings 8 are arranged in a row in the main scanning direction. In each of the heads 202, the plurality of ejection openings 8 formed in the ejection surface 202*x* constitutes one ejection-opening group 208*x*. As illustrated in FIG. 9, the caps 41 are provided respectively for the ejection surfaces 202*x* of the six heads 202. Combinations of the ejection-opening groups 208*x* and the attachments 43*p* are the same as those in the first embodiment.

In view of the above, the printer 201 according to the present embodiment and the method of manufacturing the printer 201 can obtain the same effects as obtained in the first embodiment by the same configuration as that in the first embodiment.

Figure 10:
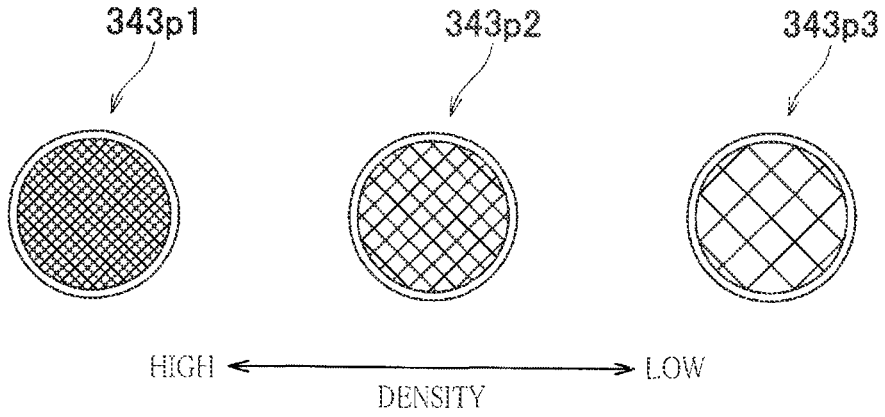
FIG. 10 is a plan view generally illustrating mesh members used in an ink-jet printer according to a third embodiment of the present invention.

There will be next explained an ink-jet printer according to a third embodiment of the present invention with reference to FIG. 10.

The printer according to the third embodiment is different from the printer 1 according to the first embodiment only in that the mesh members 343*p*1, 343*p*2, 343*p*3 are provided respectively for the branched tubes 43*b* instead of the attachments 43*p*.

Each of the mesh members 343*p*1-343*p*3 may be disposed in the suction passage 43*bx*. The density of the mesh member 343*p*1 is higher than that of the mesh member 343*p*2, and the density of the mesh member 343*p*2 is higher than that of the mesh member 343*p*3. The resistance value of the suction passage 43*bx* is larger in the branched tube 43*b* with the mesh member 343*p*2 than in the branched tube 43*b* with the mesh member 343*p*3, and the resistance value of the suction passage 43*bx* is larger in the branched tube 43*h* with the mesh member 343*p*1 than in the branched tube 43*b* with the mesh member 343*p*2.

At the assignment step S3, the mesh member 343*p*3 is assigned to the ejection-opening group 8*x* classified as the first rank, the mesh member 343*p*2 to the ejection-opening group 8*x* classified as the second rank, and the mesh member 343*p*1 to the ejection-opening group 8*x* classified as the third rank.

In view of the above, the printer according to the present embodiment and the method of manufacturing the printer 201 can obtain the same effects as obtained in the first embodiment by the same configuration as that in the first embodiment. Furthermore, the resistance values of the suction passages 43*bx* are adjusted using the mesh members 343*p*1, 343*p*2, 343*p*3 in the present embodiment, resulting in easiness and lower cost in manufacturing the printer with the uniform passage resistances in combinations of the ejection-opening groups 8*x* and the suction passages 43*bx*.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

Any number may be used as the number of ranks in the rank classification step as long as the number is two or more. For example, the plurality of ejection-opening groups may be classified into two ranks, e.g., a first rank and a second rank. The number of the attachments and the number of the mesh members in the above-described embodiments may be made corresponding to the number of ranks. In the case where the plurality of ejection-opening groups are classified into two ranks, for example, two types of attachments having ink flow passages whose cross-sectional areas are large and small may be provided.

In the above-described embodiments, the resistance values of the ejection passages are determined in the rank classification step by discharging the liquid from the ejection openings by driving of the pressurizing pump, but any method may be used to determine the resistance values. For example, the resistance values of the ejection passages may be determined based on the cross-sectional areas of the ejection passages which are obtained from design values.

Each cap may be constituted by a plurality of components such as a bottom wall for defining the bottom portion of the recessed portion and a side wall for defining the side portion of the recessed portion. In this construction, the printer may be configured such that the side wall and the bottom wall are movable relative to each other and such that an end face of the side wall is held in contact with the bottom wall with the cap being located at the capping position, and the side wall and the bottom wall are spaced apart from each other with the cap being located at the uncapping position. The cap may be configured such that the side wall is fixed to the liquid ejection head, and the bottom wall is constituted by a plate or a conveyor belt opposed to the liquid ejection head.

While the moving device moves the caps in the above-described embodiments, the moving device may move the liquid ejection head and may move both of the liquid ejection head and the caps. A plurality of the sucking devices may he provided respectively for the caps. In this construction, the sucking devices may be driven on different driving conditions such as a length of time of driving and a suction force. The suction passage may not he branched between the caps and the sucking device. While the suction tube includes the main tube and the branched tubes in the above-described embodiments, one suction tube for connecting the cap and the sucking device may be provided for each cap, for example. The adjuster may be any mechanism other than the mechanism including the cam. Alternatively, the adjuster may be omitted. Also, the pressure sensor may be omitted.

The passage resistance value of the portion of the suction passage is adjusted using the attachment 43*p* in the first and second embodiments, but this invention is not limited to this configuration. For example, a plurality of suction tubes having different inside diameters may be provided to adjust a passage resistance value of an entire suction passage. The structure in the above-described embodiments may be combined. For example, the passage resistance value may be adjusted using both of the attachments 43*p* in the first embodiment and the mesh members 343*p*1-343*p*2 in the third embodiment.

The suction condition may include not only the amount of adjustment by the adjuster but also the driving condition of the sucking device which is assigned to each cap (such as the length of time of driving and the suction force). The suction condition is determined based on the signal transmitted from the pressure sensor in the above-described embodiments but may be determined based on information used at the rank classification step and the assignment step (e.g., the resistance values of the ejection passages which correspond to the respective ejection-opening groups and the resistance values of the respective suction passages). The suction condition storage step may be omitted.

The elements for applying energy to the liquid in the ejection passages to eject the liquid from the ejection openings are not limited to the piezoelectric elements and may be elements such as electrostatic elements and resistance heating elements. The number of the ejection-opening groups is not limited to six, and two or more ejection-opening groups may be used. The liquid ejection head is not limited to the line head and may a serial head. The liquid to be ejected from the liquid ejection head is not limited to the ink and may be any liquid such as pretreatment liquid. The liquid ejection apparatus according to the present invention is not limited to the printer and may be any device such as a facsimile machine and a copying machine. The recording medium is not limited to the sheet and may be any recordable media.

What is claimed is:

1. A method of manufacturing a liquid ejection apparatus, the liquid ejection apparatus comprising:

at least one liquid ejection head comprising: a plurality of ejection-opening groups each constituted by a plurality of ejection openings for ejecting liquid; and a plurality of ejection-passage groups respectively corresponding to the plurality of ejection-opening groups and each constituted by a plurality of ejection passages respectively extending to the plurality of ejection openings of a corresponding one of the plurality of ejection-opening groups;

a plurality of caps provided respectively for the plurality of ejection-opening groups and formed respectively with a plurality of recesses each for covering the plurality of ejection openings of a corresponding one of the plurality of ejection-opening groups;

a moving device configured to move the plurality of caps relative to the at least one liquid ejection head to a capping position at which each of the plurality of recesses covers a corresponding one of the plurality of ejection-opening groups and an uncapping position at which each of the plurality of caps is spaced apart from a corresponding one of the plurality of ejection opening groups;

a plurality of suction passages respectively communicating with the plurality of recesses respectively formed in the plurality of caps;

at least one sucking device configured to suck fluid through the plurality of suction passages from the plurality of recesses respectively formed in the plurality of caps;

a controller configured to control the moving device to move each of the plurality of caps selectively to one of the capping position and the uncapping position and control the at least one sucking device such that when each of at least one of the plurality of caps is located at the capping position, a corresponding at least one of the at least one sucking device sucks the fluid from at least one of the plurality of recesses which corresponds to the at least one of the plurality of caps, the method comprising:

a classification step of classifying at least one ejection-opening group of the plurality of ejection-opening groups as a first group and classifying another at least one ejection-opening group of the plurality of ejection-opening groups as a second group, the at least one ejection-opening group each corresponding to a corresponding one of the plurality of ejection-passage groups which has a resistance value equal to or greater than a first value, said another at least one ejection-opening group each corresponding to a corresponding one of the plurality of ejection-passage groups which has a resistance value less than the first value; and an assignment step of assigning at least one suction passage of the plurality of suction passages to each of the at least one ejection-opening group classified as the first group in the classification step and assigning another at least one suction passage of the plurality of suction passages to each of the at least one ejection-opening group classified as the second group in the classification step, a resistance value of the at least one suction passage being less than a second value, a resistance value of said another at least one suction passage being equal to or greater than the second value.

2. The method according to claim 1, wherein the assignment step comprises assigning the plurality of suction passages such that a cross-sectional area of the at least one suction passage to be assigned to the at least one ejection-opening group classified as the first group is different from a cross-sectional area of said another at least one suction passage to be assigned to the at least one ejection-opening group classified as the second group.

3. The method according to claim 1, wherein the assignment step comprises assigning the at least one suction passage respectively to the at least one ejection-opening group classified as the first group and assigning said another at least one suction passage respectively to the at least one ejection-opening group classified as the second group, the at least one suction passage having the resistance value less than the second value and each provided with a mesh member therein, said another at least one suction passage having the resistance value equal to or greater than the second value and each provided with a mesh member therein.

4. The method according to claim 1, wherein the at least one sucking device is one sucking device which sucks the fluid from the plurality of recesses respectively formed in the plurality of caps.

5. The method according to claim 1, wherein the plurality of ejection-opening groups are formed in one component as the at least one liquid ejection head.

6. The method according to claim 1, wherein the at least one liquid ejection head is configured to eject the liquid onto a recording medium in a state in which the at least one liquid ejection head is fixed in the liquid ejection apparatus.

7. The method according to claim 1, further comprising a suction condition storage step of storing, into a storage device of the liquid ejection apparatus, a suction condition for the suction for a combination of each of the plurality of ejection-opening groups and corresponding at least one of the plurality of suction passages assigned at the assignment step.

8. The method according to claim 7, wherein the liquid ejection apparatus further comprises a plurality of pressure sensors provided respectively for the plurality of suction passages and each configured to output a signal indicative of a pressure in a corresponding one of the plurality of suction passages, and wherein the suction condition is determined based on the signal output from each of the plurality of pressure sensors.

9. The method according to claim 7, wherein the liquid ejection apparatus further comprises a plurality of adjusters provided respectively for the plurality of suction passages and each configured to adjust a resistance value of a corresponding one of the plurality of suction passages, and wherein the suction condition comprises an amount of adjustment of each of the plurality of adjusters.

10. The liquid ejection apparatus manufactured in the method according to claim 1, further comprising:

a plurality of pressure sensors provided respectively for the plurality of suction passages and each configured to output a signal indicative of a pressure in a corresponding one of the plurality of suction passages; and a plurality of adjusters provided respectively for the plurality of suction passages and each configured to adjust a resistance value of a corresponding one of the plurality of suction passages, wherein the controller is configured to control the plurality of adjusters based on the signals output respectively from the plurality of pressure sensors.

* * * * *